US005213632A

United States Patent [19]

Peeters et al.

[11] Patent Number: 5,213,632

[45] Date of Patent: May 25, 1993

[54] PROCESS FOR OBTAINING A HIGH-STRENGTH STRAIN-HARDENED STEEL WIRE USABLE FOR MAKING REINFORCING CABLES FOR ELASTOMERIC ARTICLES, SUCH AS PNEUMATIC TIRES, AND REINFORCING ELEMENTS (CABLES) PRODUCED FROM SUCH WIRES

[75] Inventors: Luc Peeters, Phoenix, Ariz.; Jean B. Pelletier, Tronville en Barrois, France

[73] Assignee: Sodetal Sarl, France

[21] Appl. No.: 828,964

[22] PCT Filed: Jun. 6, 1991

[86] PCT No.: PCT/FR91/00446

§ 371 Date: Feb. 5, 1992

§ 102(e) Date: Feb. 5, 1992

[87] PCT Pub. No.: WO91/19014

PCT Pub. Date: Dec. 12, 1991

[30] Foreign Application Priority Data

Jun. 7, 1990 [FR] France ..... 90 07311

[51] Int. Cl.[5] ..... C21D 8/06; C22C 38/00

[52] U.S. Cl. ..... 148/320; 148/598

[58] Field of Search ..... 148/320, 598

[56] References Cited

U.S. PATENT DOCUMENTS 3,617,230 11/1971 Richards et al. ..... 29/193

4,889,567 12/1989 Fujiwara et al. ..... 148/598

FOREIGN PATENT DOCUMENTS 53-131219 11/1978 Japan ..... 148/598

*Primary Examiner*—Deborah Yee

*Attorney, Agent, or Firm*—Wall and Roehrig

[57] ABSTRACT

A process is disclosed for obtaining a high-strength, strain-hardened steel wire by drawing a rod wire, optionally with intermediate thermal treatment. The rod wire is produced from a steel that is devoid of proeutectoid cementoid, and which comprises 0.45–0.75% C, less than 0.010% each of S and P, and conventional proportions of Mn, Si, Ca, Mo, and Al. The wire-drawing operation is carried out in two distinct phases, separated from each other by a single brassing-patenting treatment. In the final wire-drawing step the level of cross-sectional reduction is greater than 97 per cent. The level of cross-sectional reduction is also exceptionally high during the first wire-drawing phase as a result of elimination of conventional intermediate patenting.

4 Claims, No Drawings

PROCESS FOR OBTAINING A HIGH-STRENGTH STRAIN-HARDENED STEEL WIRE USABLE FOR MAKING REINFORCING CABLES FOR ELASTOMERIC ARTICLES, SUCH AS PNEUMATIC TIRES, AND REINFORCING ELEMENTS (CABLES) PRODUCED FROM SUCH WIRES

The present invention relates to a process enabling a high-strength strain-hardened steel wire to be obtained which is usable in particular for making reinforcing strands and cables of elastomeric articles such as pneumatic tires; it also relates to the reinforcing elements (strands and cables) produced from wires obtained by such a process.

The strands and cables for the reinforcing of pneumatic tires are usually composed of steel wires comprising, in addition to iron:

C: 0.68 to 0.84%
Mn: 0.40 to 0.70%
Si: 0.20 to 0.30%
Al: less than 0.005%
S: less than 0.020%
P: less than 0.020%
N: less than 0.010%
Ni, Cu, Cr, Mo, Co : less than 0.050% each
the balance being iron.

These wires, whose diameter is between approximately 0.10 and 0.50 mm, more generally between 0.15 and 0.40 mm, are manufactured from a wire called "rod wire" of standard diameter of 5.5 mm, by wire drawing in several steps with intermediate thermal treatment or patenting. The conventional process comprises the following steps:

application of a first series of wire-drawing passes in order to bring the wire to a diameter in the vicinity of 3 mm (level of cross-section reduction of approximately 70%);

patenting, for example lead patenting in order to give the wire a drawability capacity again;

application of a second series of passes (level of cross-section reduction of approximately 85 to 94%);

brassing patenting;

application of a third series of wire-drawing passes in order to attain the final diameter desired (level of final cross-section reduction of 90 to 96%, even 97%).

In certain circumstances, for ordinary steel grades and depending on the final diameter desired, the three first steps may be replaced by a single wire-drawing step to a diameter of approximately 1.35 to 1.80 mm.

It should be noted that, generally, the more the diameter is reduced the greater may be the applied level of cross-section reduction.

Conventional wires of ordinary or standard quality are distinguished from second-generation wires called high-strength wires. These two types of wire are both obtained from steel chosen from within the abovementioned composition, by causing the carbon content and, optionally, the final level of cross-section reduction to be varied.

The ordinary quality wires which have, for example, a typical fracture strength of 2850 MPa are obtained from a steel having 0.72% (+0.02) carbon with application of a level of final cross-section reduction of 95 to 96.5%.

The high-strength wires are obtained from a steel having 0.82% (±0.02) carbon with application of a final level of reduction of between 96 and 97%, the latter value being in practice only attained very occasionally. They have a fracture strength which can reach 3200 to 3450 MPa. However, the latter steel grade comes dangerously close to the metal of a physical limit called "eutectoid point" beyond which brittle phases of proeutectoid cementite appear, rendering the wire drawing and especially the stranding virtually impossible because of the high number of breaks. This limit, which depends on the diameter, increases as the diameter decreases and is difficult to determine insofar as a certain quantity of wire may pass the axial deformation test in the course of the wire drawing, but not the deformation stresses imposed during the assembling operations.

The manufacture of high-strength wires therefore requires being surrounded by precautions, which increases the cost, as much to the steelmaker, for the supplying of a rod wire free of segregations (brittle phases), as to the cable manufacturer during the patenting, wire-drawing, stranding and cabling operations.

Within the range of hard and medium steels (carbon content>0.4%) and, more particularly, within the composition mentioned, usually used for pneumatic tire reinforcing wires: C content of 0.68 to 0.84% (even 0.6 to 0.9%), the high strengths are always obtained with high carbon contents, although research has been carried out in parallel in order to improve the strain-hardening capacity, which also moves in the direction of high strength.

Thus, Japanese Patent No. 60.152,659 relates to a steel wire usable as reinforcing for pneumatic tires, the said steel having the following composition:

C: 0.6 to 0.9%
Si: 0.1 to 0.5%
Mn: 0.3 to 1%
P: <0.010%
S: <0.005%
Cu+Ni+Cr: <0.10%
$O_2$: <30 ppm
$N_2$: <30 ppm.

The low P and S contents are presented as noticeably improving the fatigue strength. This patent leads to a high-strength wire, of approximately 3800 MPa, for a carbon content of 0.84%. But with this content the metal is in the zone of the eutectoid point and the problems mentioned above are not solved.

European Patent No. 0,144,811 relates to a steel wire usable as reinforcing for pneumatic tires, the said steel having the following composition:

C: 0.4 to 1.4%
Mn: 0.1 to 1%
Si: 0.1 to 0.4%
Al: <0.005%
S: <0.015% (preferably <0.010%),
the claimed originality residing in the low sulfur content, which enables the capacities of cold deformation to be increased, in particular non-axial deformations (torsion, flexure). This patent leads to a wire whose strength R in MPa is greater than 2325–1130 log d where d is the diameter of the wire expressed in mm, which, for small diameter: (d less than 0.15 mm) enables a high strength (for d=0.15, R≧3250 MPa) to be attained. However, reference to the examples enables it to be observed that, in practice, the high strengths are obtained with a steel whose carbon content is in the range 0.80 to 0.85%, which is on the whole a general result and does not solve the problem mentioned hereinabove when the limit constituted by the eutectoid point is approached.

U.S. Pat. No. 3,617,230 relates to a high-strength steel wire obtained both by a high carbon content: 0.9 to 1.1% and by the application of high levels of strain-hardening in the final phase: more than 97%, these levels being rendered possible by the use of a steel having a low S (<0.010%) and P (<0.005%) content. However, this is a steel wire which is outside the scope of the reinforcing application for tires, as much from its use: piano wire, as by its composition, in particular its carbon content which is outside the usual range of steel for tire wires, which range is given at the beginning of the text. Furthermore, the patent makes no statement about the behavior of such a wire under flexural or torsional stresses.

Numerous other documents, such as, for example, EP-A-0,169,587, EP-A-0,232,558, EP-A-0,292,039 and DE-A-2,739,484, also describe various possibilities for obtaining steel wires having high tensile strengths.

However, all the solutions proposed to date imply using steels difficult to produce, the carbon level of which is higher to the extent desired for obtaining a high tensile strength, which runs the risk of dangerous segregation as a result of the presence of proeutectoid cementite which risks appearing in high carbon-content compositions (for example at 0.82% carbon), running the risk of breakage during the stranding operation. Moreover, the solutions proposed for obtaining such high-strength wires imply the implementation of wire-drawing processes and/or intermediate treatment which are more and more complex and tricky to implement.

Now, it has been found, and this is the subject of the present invention, that it was possible to obtain such high-strength steel wires, usable in particular as reinforcing for pneumatic tires (these wires being both of the quality called standard quality and that called "high-strength" quality) by using for obtaining them steel grades having a reduced carbon level (in relation to the usual levels recommended for obtaining a given strength) and therefore making it possible to overcome the disadvantages connected with the risks of proeutectoid cementite being present.

In a general manner, the invention therefore relates to a process for obtaining a high-strength strain-hardened steel wire whose characteristics (tensile strength) are of the same order as those of a conventional wire produced in a steel having a greater carbon content, the said wire being obtained by wire drawing a rod wire with, optionally, thermal treatment and intermediate surface treatment, the said rod wire being made from a steel having a structure free of proeutectoid cementite, the composition of which comprises, in addition to iron:

C: 0.45 to 0.75%

Mn, Si, Ca, Mo, Al . . . of conventional contents; it is characterized in that:

the steel grade of the rod wire is selected from those whose S and P content is less than 0.010%;

the wire-drawing operation is carried out in two distinct phases separated from each other by a single brassing-patenting treatment and;

the level of cross-section reduction in the final wire-drawing step is greater than 97% (therefore higher than that normally used for a similar steel grade for producing a wire of the same final diameter, the level of cross-section reduction during the first wire-drawing phase therefore also being higher because of the elimination of an intermediate patenting).

Advantageously, the final level of cross-section reduction is between 97 and 98%.

Advantageously, and in practice, in accordance with the invention:

in order to produce wires called "standard variety" wires having a fracture strength between 2400 and 3000 MPa, a steel having a carbon content between 0.45 and 0.67% is used, while previously, in order to obtain the same fracture strength, a steel having a carbon content between 0.50 and 0.75% was used; by way of indication, for a fracture strength of the order of 2850 MPa, a steel with a carbon content of the order of 0.6% is used in accordance with the invention instead of a steel having 0.72%.

for producing wires called "high-strength" wires, the fracture strength of which is between 3000 and 3500 MPa, in accordance with the invention a steel having a carbon content between 0.68 and 0.75% is used, while previously it was necessary to use a steel having a carbon content of the order of 0.80; [sic] 0.82%.

In accordance with the invention, in the wire-drawing step preceding the final step, the levels of cross-section reduction are greater than those presently practiced, as stated previously.

All the treatments involved in the implementation of the process in accordance with the invention, such as surface treatments, thermal treatments and lubricants, are carried out under conditions similar to the conventional process. Thus, the patenting is advantageously carried out under conditions enabling the finest possible pearlitic structure to be obtained. Likewise, advantageously, the descaling and brassing operations are carried out under conditions leading to a good-quality coating, facilitating the passage through the wire-drawing dies.

The wire obtained by the implementation of the process in accordance with the invention is used for producing strands and cables, and this is done under standard production conditions.

The high level of cross-section reduction in the final wire-drawing step is rendered possible by the use of a steel grade which conforms to the novel composition selected, having S and P contents less than 0.010% for each of these two constituents.

The application of high levels of cross-section reduction in the final wire-drawing step leads to high-strength wires and this is so for carbon contents less than those usually required. Thus, a steel having a carbon content of 0.45 to 0.67%, instead of a steel having 0.72%, is used for obtaining ordinary quality wires: typical strength of the order of 2850 to 2900 MPa and a steel having a carbon content of 0.68 to 0.75%, instead of 0.82%, is used for obtaining high-strength wires, strength of at least 3000 MPa and most often at least 3200 MPa.

In the latter case, besides saving on the cost of the steel (steel having 0.82% of C being expensive), the invention has an important technical advantage because a steel grade in accordance with the novel composition selected is easier to produce and enables a considerable reduction, even elimination of the risks of segregation caused by the presence of proeutectoid cementite which was encountered in steels of usual composition with a carbon content greater than approximately 0.80%. Such a grade, far from the eutectoid point, better withstands the tensile, flexural and torsional stresses. There ensues a reduction in the breaks at wire drawing and at stranding and an improvement in productivity.

Other advantages are connected with the invention.

The greater deformation capacity resulting from the reduction (even the elimination) of the segregations enables the intermediate patenting (or an equivalent thermal treatment) and that of one wire-drawing step to be eliminated.

Thus, by means of the claimed process and for relatively small final diameters, it is possible to obtain the wire according to the invention from a rod wire of standard diameter of 5.5 mm in only two wire-drawing steps (instead of three) and a single patenting treatment (instead of two), that associated with brassing. This is so both for ordinary quality wire and for high-strength wire.

In the case where previously, in order to obtain fine wire in only two wire-drawing steps, 5 mm diameter rod wire which is non-standard and therefore expensive was used, it is possible to replace the latter by a standard wire of 5.5 mm diameter and to obtain the same final product by application of greater levels of cross-section reduction.

Furthermore, by keeping all the usual steps, given that the level of cross-section reduction in the final step is greater than the present level, the level of cross-section reduction in the intermediate steps will be less. This, added to the lower carbon content, leads to conditions for wire drawing from billets which are facilitated for the intermediate diameters before the brassing-patenting.

It should also be mentioned that the use of a steel having an S and P content less than 0.010% for each of these components enables not only high levels of cross-section reduction to be applied, leading to an increase in the tensile strength, but it also increases the strength of the wire to flexural and torsional stresses, which improves the behavior at stranding and at cabling by reducing the number of breaks.

However, the invention and its advantages will be better understood with the aid of the examples hereinbelow given by way of non-limiting illustration.

In these examples, the properties of the wires: strength, elongation and reduction in area are measured by means of the usual dynamometric tests. The flexural and torsional properties are measured according to the ISO 7801 and ISO 7800 standards, respectively.

The steel grades are defined by the C, Mn, Si, P and S contents, it being understood that the contents for the other components: Al, Ni, Cu, Cr, Mo, Co and N conform to the values given in the general definition of the wire.

EXAMPLE 1

This example illustrate the manufacture of a standard (ordinary) quality wire by the process according to the invention compared to a wire manufactured by the usual process.

The wire according to the invention is produced from a steel of composition A: in accordance with the composition selected for the invention: 0.64% C, 0.55% Mn, 0.20% Si, 0.008% P and 0.008% S.

The present wire is produced from a steel of standard composition B: 0.72% C, 0.60% Mn, 0.22% Si, 0.015% P and 0.012% S.

The starting rod wire, for both compositions A and B, has a diameter of 5.5 mm.

The rod wire of composition A is directly wire-drawn from the 5.5 mm diameter to the 1.30 mm diameter with application of a 94.4% level of cross-section reduction, rendered possible by the composition of the steel and, in particular, the low S and P content.

The rod wire of composition B is wire-drawn from 5.5 mm to the intermediate diameter of 3.0 mm and then it is subjected to an intermediate patenting before being wire-drawn to the final diameter of 1.15 mm. Finally, the two wires are subjected to a brassing-patenting under the standard conditions.

The properties of the brassing-patented wire are summarized in the following table:

| STEEL | ϕ (mm) | STRENGTH (MPa) | ELONGATION (%) | AREA REDUCTION | FLEXES | TORSIONS |
|---|---|---|---|---|---|---|
| A | 1.30 | 1160 | 9.6 | 60.1 | 17 | 67 |
| B | 1.15 | 1250 | 9.1 | 57.9 | 19 | 70 |

The fine-wire drawing is then carried out in a humid environment in order to obtain the 0.22 mm diameter with a standard strength (ordinary quality).

A 97.14% level of cross-section reduction, in accordance with the invention, is applied to wire A. A standard level, that is 96.34%, is applied to wire B.

For the two wires, the levels of breakage at wire drawing are low and of the same order. The mechanical properties are the following:

| STEEL | CROSS-SECTION REDUCTION % | STRENGTH (MPa) | ELONGATION % | FLEXES | TORSIONS |
|---|---|---|---|---|---|
| A | 97.14 | 2930 | 2.6 | 75 | 137 |
| B | 96.34 | 2920 | 2.5 | 80 | 123 |

It should be noted that the mechanical properties of the two wires are very similar, virtually identical as regards strength and elongation.

The results of the flexural and torsional tests allow the supposition of good behavior of wire A at stranding and at cabling. This is confirmed during the manufacture of a 1×27 strand with each of the wires A and B. A substantial improvement in the number of breaks is observed with wire A.

These two wires A and B are completely interchangeable as far as their use is concerned. On the other hand, wire A according to the invention has, in addition, the advantage of the intermediate patenting operation and one wire-drawing step being removed.

Up until now, it was possible however to save on a wire-drawing step and a patenting treatment by passing directly from the 5.5 mm diameter rod wire to the intermediate wire of approximately 1.35 to 1.37 mm. However, taking into account the final level of reduction applicable (approximately 96.5% at maximum), it was not possible to obtain a final product of diameter less than or equal to 0.25 mm. Thus the implementation of this "shortened" process for obtaining fine wires (0.25 mm diameter) necessarily required using a 5 mm diameter rod wire, which is non-standard and therefore expensive. The steps were the following:

wire-drawing from the 5 mm diameter to the 1.22 mm diameter (level of cross-section reduction: 94%);

brassing patenting;

wire drawing from the 1.22 mm diameter to the 0.25 diameter (level of cross-section reduction: 95.8%).

With the present invention it is therefore possible to obtain the finished wire (0.22 to 0.25 mm diameter, for example) in only two wire-drawing steps with a single thermal treatment, and this from a 5.5 mm standard diameter rod wire, that is to say without extra cost.

EXAMPLE 2

This example illustrates the implementation of the invention in its most advantageous form. It relates to the manufacture of a high-strength wire, by the process according to the invention, in comparison with a wire manufactured by the usual process.

The wire according to the invention is produced from a steel of composition Al, in accordance with the composition selected for the invention: 0.72% C, 0.54% Mn, 0.23% Si, 0.007% P and 0.006% S.

The wire manufactured by the usual process is produced from a steel of composition B1: 0.82% C, 0.55% Mn, 0.25% Si, 0.005% P and 0.009% S. This wire, although having an S and P content less than 0.01% for each of these components, is not produced from a steel of composition in accordance with that selected for the invention. It cannot withstand high levels of cross-section reduction because, due to its C and Mn content, it comes dangerously close to the eutectoid point with the associated risks.

The starting rod wire, for the two compositions A1, and B1, has a diameter of 5.5 mm.

The rod wire of composition Al is wire-drawn directly from 5.5 mm to the final 1.48 mm diameter (level of cross-section reduction: 92.75%).

The rod wire of composition B1 is subjected to an intermediate patenting at the 3.0 mm diameter before being wire-drawn down to the 1.30 mm diameter. Then the two wires are subjected to a brassing patenting under the standard conditions; the mechanical properties of these wires are:

| STEEL | ϕ (mm) | STRENGTH (MPa) | ELONGATION (%) | AREA REDUCTION | FLEXES | TORSIONS |
|---|---|---|---|---|---|---|
| A1 | 1.48 | 1260 | 9.2 | 54.0 | 18 | 60 |
| B1 | 1.30 | 1350 | 8.8 | 48.4 | 14 | 53 |

The fine-wire drawing is carried out in a humid environment so as to obtain the high-strength 0.25 mm product. The levels of breakage are low and are identical for the two wires.

The wires have the following characteristics:

| STEEL | FINAL CROSS-SECTION REDUCTION % | STRENGTH (MPa) | ELONGATION % | FLEXES | TORSIONS |
|---|---|---|---|---|---|
| A1 | 97.15 | 3250 | 2.5 | 80 | 110 |
| B1 | 96.30 | 3270 | 2.6 | 84 | 107 |

It is observed that the two wires have practical identical characteristics and therefore are interchangeable as regards their uses. The behavior at stranding of the wire A1 according to the invention is good, the level of breakage even being reduced in relation to the wire B1. Furthermore, this wire offers the advantage of eliminating the intermediate patenting and one wire-drawing step. Above all, it enables avoiding the use of 0.82% carbon rod wire which has not only a cost premium at purchase but also the risk of brittle phases (proeutectoid cementite) causing breaks at wire drawing and at stranding despite all the precautions which may be taken, these breaks leading to a reduction in productivity.

EXAMPLE 3

This example illustrates the production of small-diameter wires, such as high-strength 0.175 mm and standard-quality 0.150 mm wires, by implementing very high levels of cross-section reduction (97.5% to 98%) while being capable of correct stranding and with an acceptable level of breaks, these wires being used in particular in the production of products such as 1×27 and 1×12 compact cables (all the wires being twisted together in the same direction and with the same pitch).

The steels used both have a composition in accordance with that selected for the invention:

A2: 0.73% C, 0.55% Mn, 0.20% Si, 0.009% P, 0.007 [sic] S

A3: 0.56% C, 0.57% Mn, 0.24% Si, 0.007% P, 0.008 [sic] S

The starting wires are 5.5 mm diameter rod wires for the two types of steel A2 and A3; these wires, after a first wire-drawing, lead to 3.0 mm diameter wires.

The intermediate wires stem from the patented 3.0 mm diameter. After dry wire-drawing, a conventional brassing-patenting is carried out finishing up with the following mechanical properties:

| STEEL | ϕ (mn [sic] | STRENGTH after patent-ing (MPa) | ELONGA-TION (%) | AREA REDUC-TION | FLEXES | TORSIONS |
|---|---|---|---|---|---|---|
| A2 | 1.19 | 1265 | 9.0 | 53.0 | 26 | 75 |
| A3 | 1.04 | 1080 | 9.8 | 60.4 | 30 | 80 |

During the wet-wire drawing, the wire A2 gives the high-strength 0.175 mm diameter used, in particular, for stranding for the 1×27 construction. The wire A3 is converted to the 0.15 mm diameter used as covering wire. The mechanical properties of these fine wires are:

| STEEL | CROSS-SECTION REDUC-TION (%) | ϕ (mm) | STRENGTH (MPa) | ELONGA-TION (%) | FLEXES | TORSIONS |
|---|---|---|---|---|---|---|
| A2 | 97.84 | 0.175 | 3440 | 2.6 | 129 | 145 |
| A3 | 97.92 | 0.150 | 2915 | 2.3 | 131 | 174 |

It is observed that, on the one hand, a high-strength wire is obtained from a steel having only 0.73% carbon, which places it very far from the problem zone situated close to the eutectoid point and, on the other hand, an ordinary quality wire is obtained from a steel having only 0.56% carbon.

The cable produced, without any particular problem, from the wire A2 covered with the wire A3, has a strength comparable, even greater, than that of the cables produced from the usual wires having 0.82% carbon. In all cases the other properties of the cable, such as fatigue, adherence (at the beginning and after ageing), remain unchanged.

It clearly emerges from the description and the examples which have been given that the invention therefore has numerous advantages, among which may be mentioned:

use of steel which is easier to produce:

less risk of dangerous segregation because of the presence of proeutectoid cementite, which runs the risk of appearing in steel compositions having a high carbon content (0.82%), and therefore a reduction in breaks at stranding;

easier elimination of the intermediate patenting because of the increase of the intermediate diameters and of the wire-drawing facilitated by a lower carbon level.

We claim:

1. A process for making a high-strength, strain-hardened steel wire, comprising the steps of:

performing a first wire drawing operation on a rod wire to yield a drawn wire, said rod wire being fabricated from a steel that is free of proeutectoid cementite, said steel comprising carbon in the range of about 0.45 to 0.67 percent, less than 0.010 per cent sulfur, and less than 0.010 per cent phosphorus;

performing a brassing-patenting treatment on said drawn wire; and thereafter performing a second wire drawing operation on the drawn wire until the cross-section of the rod wire is reduced by at least 97 per cent;

whereby the high-strength, strain-hardened steel wire that is produced has a fracture strength between 2400 and 3000 mPa.

2. A process for making a high-strength, strain-hardened steel wire, comprising the steps of:

performing a first wire drawing operation on a rod wire to yield a drawn wire, said rod wire being fabricated from a steel that is free of proeutectoid cementite, said steel comprising carbon in the range of about 0.68 to 0.75 per cent, less than 0.010 per cent sulfur, and less than 0.010 per cent phosphorus;

performing a brassing-patenting treatment on said drawn wire; and thereafter performing a second wire drawing operation on the drawn wire until the cross-section of the rod wire is reduced by at least 97 per cent;

whereby the high-strength, strain-hardened steel wire that is produced has a fracture strength between 3000 and 3500 mPa.

3. A steel wire, produced by the process of claim 1.

4. A steel wire, produced by the process of claim 2.

* * * * *